US008773335B2

(12) United States Patent
Yamashita et al.

(10) Patent No.: US 8,773,335 B2
(45) **Date of Patent: *Jul. 8, 2014**

(54) DISPLAY DEVICE AND ELECTRONIC EQUIPMENT

(71) Applicant: Sony Corporation, Tokyo (JP)

(72) Inventors: Junichi Yamashita, Tokyo (JP); Takao Tanikame, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/057,005

(22) Filed: Oct. 18, 2013

(65) Prior Publication Data

US 2014/0043218 A1 Feb. 13, 2014

Related U.S. Application Data

(63) Continuation of application No. 13/456,298, filed on Apr. 26, 2012, which is a continuation of application No. 12/923,475, filed on Sep. 23, 2010, now Pat. No. 8,217,878, which is a continuation of application No. 11/878,683, filed on Jul. 26, 2007, now Pat. No. 7,825,879.

(30) Foreign Application Priority Data

Aug. 3, 2006 (JP) ..... 2006-212579

(51) Int. Cl.
*G09G 3/30* (2006.01)

(52) U.S. Cl.
USPC ..... 345/76; 345/77; 345/82; 315/169.1; 315/169.3

(58) Field of Classification Search
USPC ..... 345/76–83, 204, 690; 315/169.1–169.3
See application file for complete search history.

(56) References Cited

U.S. PATENT DOCUMENTS

| | | | | |
|---|---|---|---|---|
| 6,356,029 | B1 * | 3/2002 | Hunter | 315/169.1 |
| 6,646,363 | B2 | 11/2003 | Kylander et al. | |
| 7,564,433 | B2 | 7/2009 | Hector et al. | |
| 7,589,707 | B2 | 9/2009 | Chou | |
| 7,646,363 | B2 | 1/2010 | Yamashita et al. | |
| 7,659,872 | B2 | 2/2010 | Yamashita et al. | |

(Continued)

FOREIGN PATENT DOCUMENTS

| | | |
|---|---|---|
| JP | 2003-255856 A | 9/2003 |
| JP | 2003-271095 A | 9/2003 |

(Continued)

*Primary Examiner* — Jennifer Nguyen
(74) *Attorney, Agent, or Firm* — Rader, Fishman & Grauer PLLC

(57) ABSTRACT

A display device is disclosed. The display device includes: a pixel array unit and a driving unit which drives the pixel array unit. The pixel array unit includes rows of first scanning lines and second scanning lines, columns of signals, pixels in a matrix state arranged at portions where the scanning lines and the signal lines cross each other and power supply lines and ground lines supplying power to respective pixels. The driving unit includes a first scanner performing line-sequential scanning to pixels by each row by supplying a first control signal to each first scanning line sequentially, a second scanner supplying a second control signal to each second scanning line sequentially so as to correspond to the line-sequential scanning and a signal selector supplying a video signal to rows of signal lines so as to correspond to the line-sequential scanning.

25 Claims, 18 Drawing Sheets

(56) References Cited

U.S. PATENT DOCUMENTS

| | | | | |
|---|---|---|---|---|
| 7,688,292 | B2 * | 3/2010 | Park et al. | 345/82 |
| 7,868,880 | B2 | 1/2011 | Ozaki et al. | |
| 8,217,878 | B2 * | 7/2012 | Yamashita et al. | 345/92 |
| 2004/0246209 | A1 | 12/2004 | Sung | |
| 2005/0083270 | A1 | 4/2005 | Miyazawa | |
| 2005/0269959 | A1 | 12/2005 | Uchino et al. | |
| 2012/0206329 | A1 * | 8/2012 | Chen | 345/156 |

FOREIGN PATENT DOCUMENTS

| | | | |
|---|---|---|---|
| JP | 2004-029791 | A | 1/2004 |
| JP | 2004-093682 | A | 3/2004 |
| JP | 2004-133240 | A | 4/2004 |

* cited by examiner $$I_{ds} = k\mu\,(V_{gs} - V_{th})^2 = k\mu\,(V_{sig} - \Delta V)^2$$

DISPLAY DEVICE AND ELECTRONIC EQUIPMENT

CROSS REFERENCE TO RELATED APPLICATIONS

This is a Continuation application of U.S. patent application Ser. No. 13/456,298, filed Apr. 26, 2013, which is a Continuation application Ser. No. 12/923,475, filed Sep. 23, 2010, now U.S. Pat. No. 8,217,878, issued on Jul. 10, 2012, which is a Continuation application of U.S. patent application Ser. No. 11/878,683, filed Jul. 26, 2007, now U.S. Pat. No. 7,825,879, filed on Nov. 2, 2010, which claims priority from Japanese Application JP 2006-212579, filed in the Japan Patent Office on Aug. 3, 2006, the entire contents of which being incorporated herein by reference.

BACKGROUND OF THE INVENTION

1. Field of the Invention

The invention relates to a display device displaying pictures by driving light emitting elements by current, which are arranged at each pixel. Particularly, the invention relates to a so-called active matrix display device which controls a current amount flowing in the light emitting element such as an organic EL by an insulated-gate field effect transistor provided in each pixel circuit. In addition, the invention relates to electronic equipment in which such display device is incorporated.

2. Description of the Related Art

In a display device, for example, in a liquid crystal display, a lot of liquid crystal pixels are arranged in a matrix state, and pictures are displayed by controlling transmittance intensity or reflectance intensity of incident light by each pixel according to picture information to be displayed. The same applies to an organic EL display using organic EL elements in pixels, however, the organic EL element is a self-light emitting element, which is different from the liquid crystal pixel. Therefore, the organic EL display has advantages such that visibility of pictures is high as compared with the liquid crystal display, that a backlight is not necessary and that response speed is high. In addition, luminance level (gradation) of each light emitting element can be controlled according to a current value flowing in the element, and the organic EL display is totally different from a voltage controlled type such as the liquid crystal display in a point that the EL display is a so-called current controlled type.

In the organic EL display, there are a simple matrix system and an active matrix system as a drive system thereof as is the case with the liquid crystal display. Though the former has simple configuration, it has problems such that it is large and it is difficult to realize high-definition display, therefore, the active matrix system are developed extensively at present. In the system, electric current flowing in the light emitting element in each pixel circuit is controlled by active elements (generally, thin-film transistors, TFTs) provided in the pixel circuit, which is disclosed in JP-A-2003-255856, JP-A-2003-271095, JP-A-2004-133240, JP-A-2004-029791 and JP-A-2004-093682.

SUMMARY OF THE INVENTION

Pixel circuits in related arts are arranged at portions where rows of scanning lines supplying control signals and columns of signal lines supplying video signals cross each other, each of which includes at least a sampling transistor, a pixel capacitor, a drive transistor and a light emitting element. The sampling transistor is turned on according to a control signal supplied from the scanning line and samples a video signal supplied from the signal line. The pixel capacitor stores an input voltage in accordance with a signal potential of the video signal which was sampled. The drive transistor supplies output current as drive current in a prescribed light emitting period according to the input voltage stored in the pixel capacitor. In general, output current has dependence with respect to carrier mobility and a threshold voltage in a channel region of the drive transistor. The light emitting element emits light in luminance in accordance with the video signal by the output current supplied from the drive transistor.

The drive transistor receives the input voltage stored in the pixel capacitor at a gate and allows output current to flow between a source and a drain to turn on the light emitting element. In general, the light-emitting luminance of the light emitting element is in proportion to an amount of current flowing. An amount of supplying output current of the drive transistor is controlled by the gate voltage, that is, the input voltage written in the pixel capacitor. In the pixel circuit in related arts, the current amount to be supplied to the light emitting element is controlled by changing input voltage to be applied to the gate of the drive transistor according to an input video signal.

Operating characteristics of the drive transistor are represented by a formula 1 below.

$$Ids=(1/2)\mu(W/L)Cox(Vgs-Vth)2 \quad (1)$$

In the transistor characteristic formula 1, "Ids" denotes a drain current flowing between source/drain, which is output current supplied to the light emitting element in the pixel circuit. "Vgs" denotes a gate voltage applied to the gate based on the source, which is the input voltage in the pixel circuit. "Vth" denotes a threshold voltage of the transistor. "μ" denotes mobility of a semiconductor thin film forming the channel of the transistor. "W" denotes a channel width, "L" denotes a channel length and "Cox" denotes a gate capacitance. As apparent from the transistor characteristic formula 1, during operation of the thin-film transistor in a saturation region, when the gate voltage Vgs exceeds the threshold voltage Vth, the thin-film transistor is turns on, and the drain current Ids flows. In principle, as shown by the transistor characteristic formula 1, the constant amount of drain current Ids is regularly supplied to the light emitting element when the gate voltage Vgs is fixed. Therefore, video signals having the same level are supplied to all respective pixels forming a screen, the all pixels emit light at the same luminance, as a result, uniformity of the screen can be obtained.

However, a thin-film transistor (TFT) made of a semiconductor thin film such as polysilicon has variations in respective device characteristics. Particularly, a threshold voltage Vth is not fixed and has variations according to each pixel. As apparent from the transistor characteristic formula 1, when the threshold voltage Vth of each drive transistor varies, the drain current Ids varies and the luminance varies according to each pixel even when the gate voltage Vgs is fixed, which impairs the uniformity of the screen. A pixel circuit in which a function of canceling variations of the threshold voltage of the drive transistor is incorporated has been developed in the past, which is disclosed, for example, in the Patent Document 3 as described above.

However, a factor of output current variations with respect to the light emitting element is not only the threshold voltage Vth of the drive transistor. As apparent from the transistor characteristic formula 1, output current Ids varies also when the mobility μ of the drive transistor varies. As a result, the uniformity of the screen is impaired. It is desirable to correct mobility variations.

According to an embodiment of the invention, there is provided a display device in which a mobility correction function of the drive transistor is incorporated in each pixel. Particularly, according to the embodiment of the invention, variations of a mobility correction period is suppressed, thereby further increasing the uniformity of the screen of the display device. A display device according to the embodiment of the invention basically includes a pixel array unit and a driving unit which drives the pixel array unit. The pixel array unit includes rows of first scanning lines and second scanning lines, columns of signals, pixels in a matrix state arranged at portions where the scanning lines and the signal lines cross each other, power supply lines and ground lines supplying power to respective pixels. The driving unit includes a first scanner performing line-sequential scanning to pixels by each row by supplying a first control signal to each first scanning line sequentially, a second scanner supplying a second control signal to each second scanning line sequentially so as to correspond to the line-sequential scanning and a signal selector supplying a video signal to rows of signal lines so as to correspond to the line-sequential scanning. The pixel includes a light emitting element, a sampling transistor, a drive transistor, a switching transistor and a pixel capacitor. The sampling transistor is connected to the first scanning line at a gate thereof, connected to the signal line at a source thereof, connected to a gate of the drive transistor at a drain thereof. The drive transistor and the light emitting element form a current path by being connected in series between the power supply line and the ground line. The switching transistor is inserted into the current path and connected to the second scanning line at the gate thereof. The pixel capacitor is connected between a source and a gate of the drive transistor. The sampling transistor is turned on according to the first control signal supplied from the first scanning line and samples a signal potential of the video signal supplied from the signal line to be stored in the pixel capacitor. The switching transistor is turned on according to the second control signal supplied from the second scanning line to allow the current path to be conductive. The drive transistor allows drive current to flow in the light emitting element through the current path which is in the conductive state according to the signal potential stored in the pixel capacitor. The driving unit, after turning on the sampling transistor by applying the first control signal to the first scanning line and starts sampling of the signal potential, gives correction with respect to mobility of the drive transistor to the signal potential stored in the pixel capacitor in a correction period from a first timing when the switching transistor is turned on by the second control signal being applied to the second scanning line until a second timing when the sampling transistor is turned off by the first control signal applied to the first scanning lines being cancelled. At that time, the driving unit adjusts the second timing automatically so that the correction period becomes short when the signal potential of the video signal supplied to the signal line is high, whereas so that the correction period becomes long when the signal potential of the video signal supplied to the signal line is low, and the drive transistor sets a size ratio W/L thereof to 0.5 or more when a channel width is W and a channel length is L, shortening the correction period as a whole by increasing supplying ability of drive current of the drive transistor during the correction period.

It is preferable that the drive transistor sets the size ratio W/L thereof to 1.0 or more. The first scanner adjusts the second timing automatically so that the correction period becomes short when the signal potential of the video signal supplied to the signal line is high, and so that the correction period becomes long when the signal potential is low by allowing a falling waveform of the first control signal to be inclined when the sampling transistor is turned off at the second timing. The first scanner optimizes the correction period at both cases when the signal potential is high and when the signal potential is low by allowing the falling waveform to be a steep inclination at first and then to be a moderate inclination, dividing the period into at least two stages when allowing the falling waveform of the first control signal to be inclined. Each pixel includes an additional switching transistor resetting a gate potential and a source potential of the drive transistor before the sampling of the video signal and the second scanner turns on the switching transistor through the second control line temporarily before the sampling of the video signal, thereby allowing drive current to flow in the reset drive transistor to store voltage corresponding to a threshold voltage in the pixel capacitor.

According to an embodiment of the invention, the correction with respect to the mobility of the drive transistor (mobility correction operation) is performed in the correction period from the first timing when the switching transistor is turned on until the second timing when the sampling transistor is turned off, after the sampling transistor is turned on and the sampling of the signal potential is started. Specifically, drive current flowing in the drive transistor is fed back negatively to the pixel capacitor during the correction period according to the signal potential to adjust the stored signal potential. When the mobility of the drive transistor is large, an amount of negative feedback becomes large accordingly, and a reduced amount of the signal potential increases, as a result, the drive current can be reduced. On the other hand, when the mobility of the drive transistor is small, the amount of negative feedback with respect to the pixel capacitor becomes small, therefore, the reduced amount of the stored signal potential is small. Accordingly, the drive current is not reduced drastically. As described above, the signal potential is adjusted in a direction canceling the mobility according to the size of the mobility of the drive transistor of each pixel. Therefore, even though the mobility of the drive transistor of each pixel varies, each pixel gives light emitting luminance having almost the same level with respect to the same signal potential. Accordingly, the uniformity of the screen can be improved.

The optimum mobility correction period is not always fixed, and it is preferable to set the mobility correction period to be optimum according to the signal potential. In general, the optimum correction period tends to be short when the signal potential is in white and high, and the optimum correction period tends to be long as the signal potential decreases from the gray level to the black level. In the embodiment of the invention, the uniformity of the screen is further increased by variably adjusting the mobility correction period to be optimum according to the signal potential. That is, the second timing which prescribes the end of the correction period is adjusted automatically so that the correction period becomes short when the signal potential of the video signal supplied to the signal line is high, and so that the correction period becomes long when the signal potential of the video signal supplied to the signal line is low.

When the mobility correction period is appropriately controlled according to the signal potential, the optimum correction period has to be extended as the signal level decreases, as a result, the longest correction period tends to be long. However, when the correction period becomes longer, the correction period itself varies by strongly affected by variations of on-timing of the switching transistor or off-timing of the sampling transistor, which causes deterioration of the uniformity. In the embodiment of the invention, the mobility correction period is compressed as a whole from a range in which the signal potential is high to a range in which the signal potential is low by increasing driving ability of the drive transistor which supplies drive current for negative feedback during the mobility correction period. That is, the correction amount to be added during the mobility correction period increases according to the increase of the driving ability of the drive transistor, therefore, the correction period itself can be shortened as a whole. The correction period is hardly affected by variations of the on-timing of the switching transistor or the off-timing of the sampling transistor by shortening the correction period, as a result, accurate mobility correction can be performed. Specifically, a size ratio W/L of the drive transistor which was set to less than 0.5 in related arts is set to 0.5 or more, thereby increasing the supplying ability of drive current of the drive transistor during the correction period to compress the correction period as a whole. It is more preferable to set the size ratio W/L of the drive transistor to 1.0 or more, thereby improving the uniformity of the screen remarkably.

DESCRIPTION OF THE PREFERRED EMBODIMENTS

Figure 1:
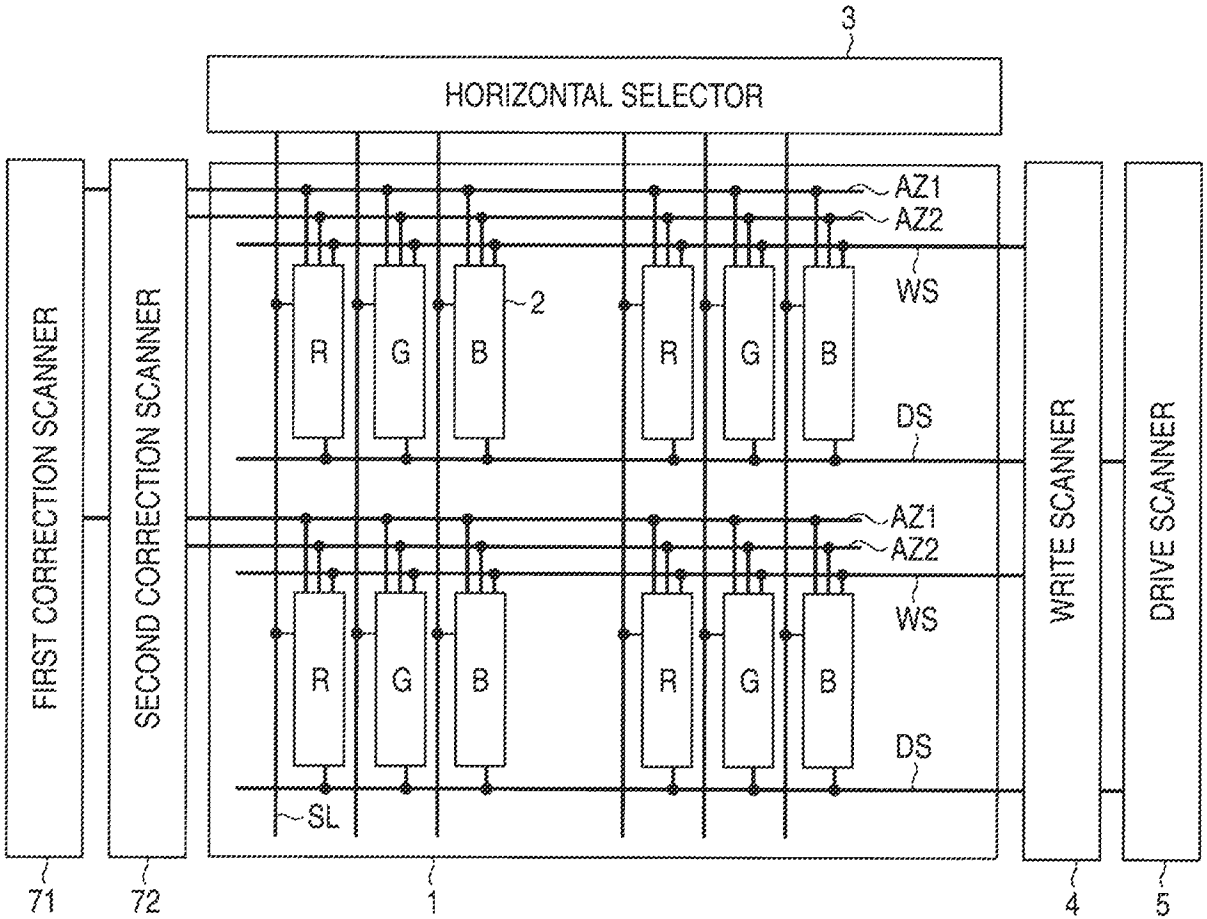
FIG. 1 is a block diagram showing the whole configuration of a display device according to an embodiment of the invention.

Hereinafter, an embodiment of the invention will be explained in detail with reference to the drawings. FIG. 1 is a block diagram showing the whole configuration of a display device according to an embodiment of the invention. As shown in the drawing, the display device basically includes a pixel array unit 1, a scanner unit and a signal unit. The scanner unit and the signal unit form a driving unit. The pixel array unit 1 includes first scanning lines WS, second scanning lines DS, third scanning lines AZ1 and fourth scanning lines AZ2 which are arranged in rows, signal lines SL which are arranged in columns, pixel circuits 2 in a matrix state which are connected to the scanning lines WS, DS, AZ1 and AZ2, and the signal lines SL, and a plurality of power supply lines supplying a first potential Vss1, a second potential Vss2 and a third potential VDD which are necessary for operation of respective pixel circuits 2. The signal unit includes a horizontal selector 3, which supplies video signals to the signal lines SL. The scanner unit includes a write scanner 4, a drive scanner 5, a first correction scanner 71 and a second correction scanner 72, each of which supplies control signals to the first scanning lines WS, the second scanning lines DS, the third scanning lines AZ1 and the fourth scanning lines AZ2 to sequentially scan the pixel circuits 2 by each row.

Figure 2:
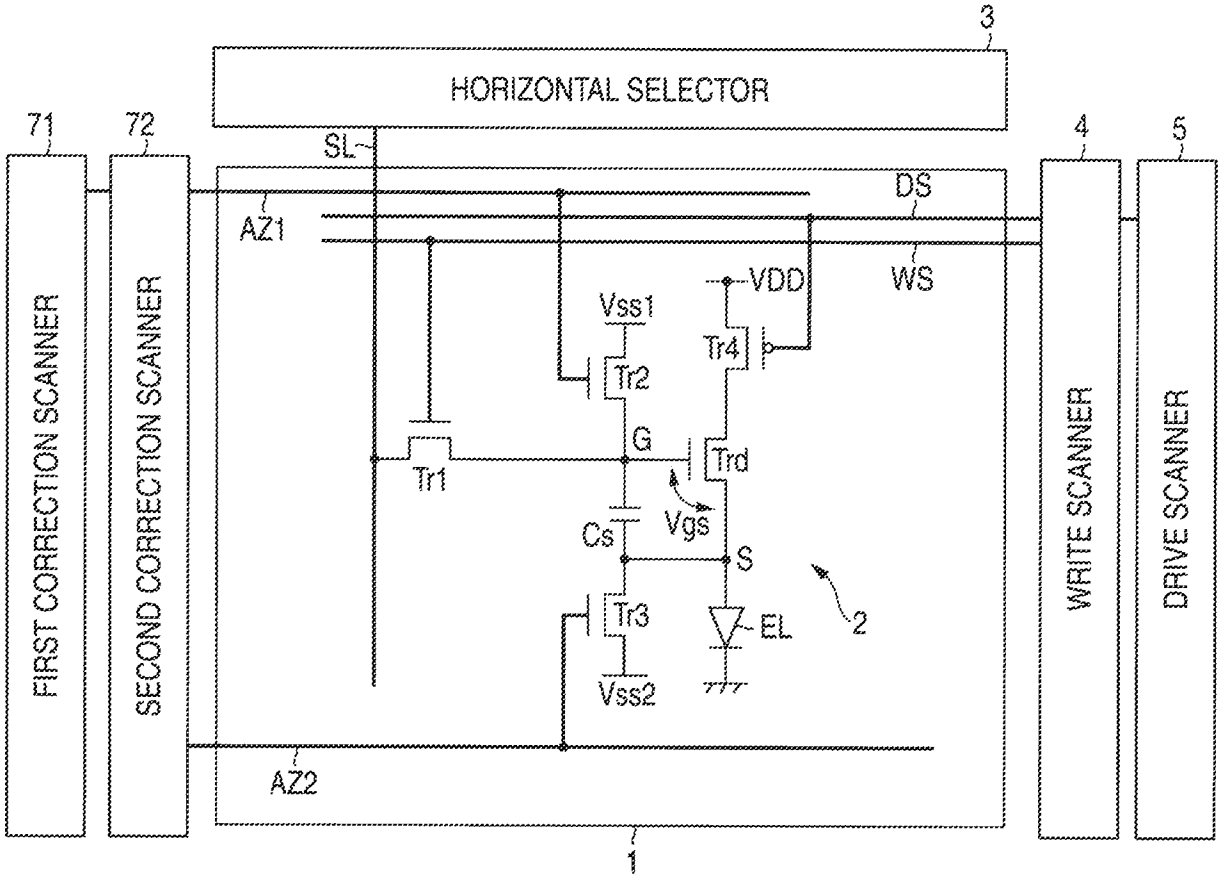
FIG. 2 is a circuit diagram showing a pixel configuration of the display device according to an embodiment of the invention.

FIG. 2 is a circuit diagram showing a pixel configuration to be incorporated in the picture display device shown in FIG. 1. As shown in the drawing, the pixel circuit 2 includes a sampling transistor Tr1, a drive transistor Trd, a first switching transistor Tr2, a second switching transistor Tr3, a third switching transistor Tr4, a pixel capacitor Cs and a light emitting element EL. The sampling transistor Tr1 is turned on according to a control signal supplied from the scanning line WS and samples a signal potential of a video signal supplied from the signal line SL in the pixel capacitor Cs in a prescribed sampling period. The pixel capacitor Cs applies an input voltage Vgs to a gate G of the drive transistor Trd according to the signal potential of the sampled video signal. The drive transistor Trd supplies output current Ids in accordance with the input voltage Vgs to the light emitting element EL. The light emitting element EL emits light at the luminance in accordance with the signal potential of the video signal by the output current Ids supplied from the drive transistor Trd in a prescribed light emitting period.

The first switching transistor Tr2 is turned on according to a control signal supplied from the scanning line AZ1 and sets the gate G of the drive transistor Trd to the first potential Vss1 before the sampling period. The second switching transistor Tr3 is turned on according to a control signal supplied from the scanning line AZ2 and sets a source S of the drive transistor Trd to the second potential Vss2 before the sampling period. The third switching transistor Tr4 is turned on according to a control signal supplied from the scanning line DS and connects the drive transistor Trd to the third potential VDD before the sampling period, thereby storing a voltage corresponding to the threshold voltage Vth of the drive transistor Trd in the pixel capacitor Cs to correct an effect of the threshold voltage Vth. In the light emitting period, the third switching transistor Tr4 is turned on again according to a control signal supplied from the scanning line DS and connects the drive transistor Trd to the third potential VDD to allow the output current Ids to flow in the light emitting element EL.

As apparent from the above explanation, the pixel circuit 2 includes five transistors Tr1 to Tr4 and Trd, one pixel capacitor Cs and one light emitting element EL. The transistors Tr1 to Tr3 and Trd are N-channel polysilicon TFTs. Only the transistor Tr4 is a P-channel polysilicon TFT. However, the invention is not limited to this, and it is preferable to both N-channel and P-channel TFTs are mixed suitably. The light emitting element EL is, for example, a diode-type organic EL device having an anode and a cathode. However, the invention is not limited to this, and the light emitting element generally includes all devices which emit light by current drive.

As a feature of an embodiment of the invention, the driving unit of the display device turns on the sampling transistor Tr1 by applying a first control signal WS to the first scanning line WS and starts sampling of the signal potential, then, gives correction with respect to the mobility μ of the drive transistor Trd to the signal potential stored in the pixel capacitor Cs in a correction period "t" from a first timing when the switching transistor TR4 is turned on by a second control signal DS being applied to the second scanning line DS until a second timing when the sampling transistor Tr1 is turned off by the first control signal WS applied to the first scanning line WS being cancelled, thereby performing the mobility correction.

Figure 3:
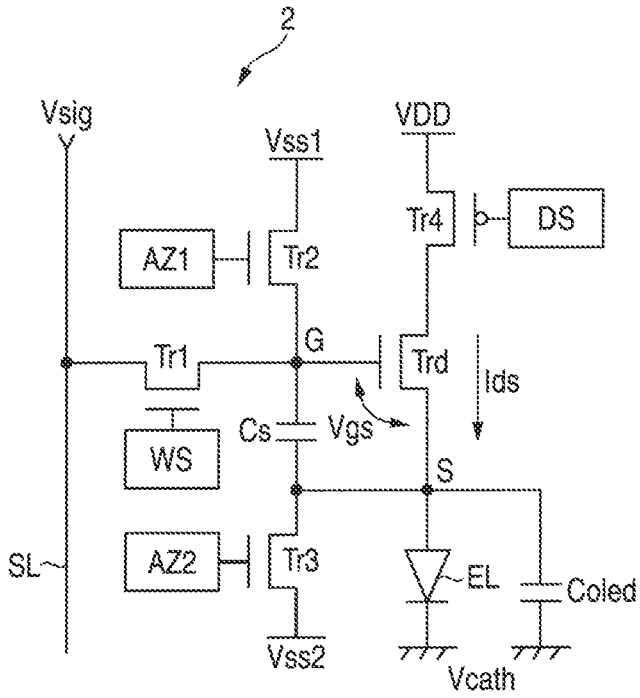
FIG. 3 is a circuit diagram for explaining operation of the display device according to an embodiment of the invention.

FIG. 3 is a schematic diagram in which only the portion of the pixel circuit 2 is taken from the picture display device shown in FIG. 2. For easy comprehension, a signal potential Vsig of the video signal to be sampled by the sampling transistor Tr1, the input voltage Vgs and the output current Ids of the drive transistor Trd, and further, a capacitive component Coled included in the light emitting element EL and the like are added. Hereafter, operation of the pixel circuit 2 according to the embodiment of the invention will be explained with reference to FIG. 3.

Figure 4:
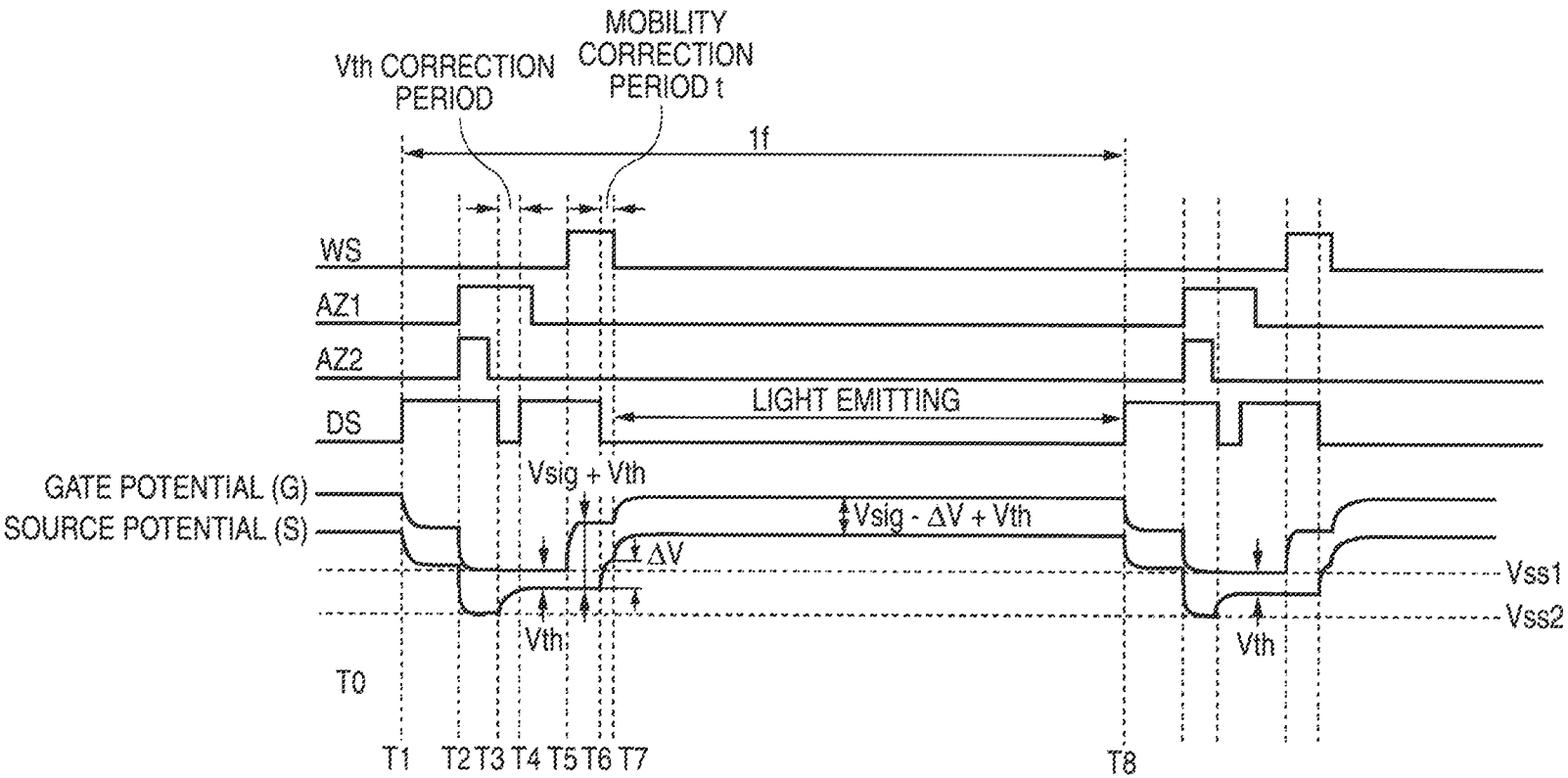
FIG. 4 is a timing chart for explaining operation of the same.

FIG. 4 is a timing chart of the pixel circuit shown in FIG. 3. The operation of the pixel circuit shown in FIG. 3 will be specifically explained with reference to FIG. 4. In FIG. 4, waveforms of control signals applied to the respective scanning lines WS, AZ1, AZ2 and DS are shown along a time axis T. In order to simplify the notation, control signals are also denoted by the same signs as signs of corresponding scanning lines. Since the transistors Tr1, Tr2 and Tr3 are N-channel transistors, they are turned on when the respective scanning lines WS, AZ1 and AZ2 are in a high level, and they are turned off at the time of a low level. On the other hand, since the transistor Tr4 is the P-channel transistor, they are turned off when the scanning line DS is in the high level and they are turned on at the time of the low level. In the timing chart, in addition to waveforms of respective control signals WS, AZ1, AZ2 and DS, potential variations of the gate G and potential variations of the source S of the drive transistor Trd are also shown.

In the timing chart of FIG. 4, timings T1 to T8 are taken as one field (1*f*). During one field, each row in the pixel array is sequentially scanned once. The timing chart shows waveforms of respective control signals WS, AZ1, AZ2 and DS applied to pixels of one row.

In a timing T0 before the field starts, all control signals WS, AZ1, AZ2 and DS are in the low level. Therefore, the N-channel transistors Tr1, Tr2, and Tr3 are in an off-state, whereas only the P-channel transistor Tr4 is in an on-state. Since the drive transistor Trd is connected to the power supply VDD through the transistor Tr4 which is in the on-state, the drive transistor Trd supplies the output current Ids to the light emitting element EL according to the prescribed input voltage Vgs. Therefore, the light emitting element EL emits light in the timing T0. At this time, the input voltage Vgs applied to the drive transistor Trd is represented by the difference between the gate potential G and the source potential S.

In a timing T1 when the field starts, the control DS is switched from the low level to the high level. According to this, the switching transistor Tr4 is turned off and the drive transistor Trd is disconnected from the power supply VDD, therefore, the light emitting is stopped and a non-light emitting period starts. When entering the timing T1, all transistors Tr1 to Tr4 becomes the off-state.

Subsequently, when entering a timing T2, the control signals AZ1 and AZ2 become the high level, therefore, the switching transistors Tr2 and Tr3 are turned on. As a result, the gate G of the drive transistor Trd is connected to the reference potential Vss1, and the source S is connected to the reference potential Vss2. Here, Vss1−Vss2>Vth is satisfied, and allowing Vss1−Vss2=Vgs>Vth, thereby preparing for correcting Vth performed in a timing T3 after that. In other words, the period T2 to T3 corresponds to a reset period of the drive transistor Trd. In addition, when the threshold voltage of the light emitting element EL is VthEL, it is set so as to be VthEL>Vss2. Accordingly, minus bias is applied to the light emitting element EL, which becomes a so-called reverse bias state. The reverse bias state is necessary for normally performing Vth correction operation and mobility correction operation which will be performed later.

In the timing T3, the control signal AZ2 is made to be the low level as well as the control signal DS is also made to be the low level just after that. Accordingly, the transistor Tr3 is turned off, whereas the transistor Tr4 is turned on. As a result, the drain current Ids flows into the pixel capacitor Cs, and the Vth correction operation is started. At this time, the gate G of the drive transistor Trd is maintained at Vss1, and the current Ids flows until the drive transistor Trd is cut off. When the drive transistor Trd is cut off, the source potential S of the drive transistor Trd becomes to be Vss1−Vth. At a timing T4 after the drain current is cut off, the control signal DS is returned to the high level again, and the switching transistor Tr4 is turned off. Furthermore, the control signal AZ1 is also returned to the low level, and the switching transistor Tr2 is also turned off. As a result, Vth is stored and fixed in the pixel capacitor Cs. Accordingly, the timing T3 to T4 is a period when the threshold voltage Vth of the drive transistor Trd is detected. Here, the detection period T3 to T4 is called as the Vth correction period.

After the Vth correction is performed as described above, the control signal WS is switched to the high level in a timing T5, and the sampling transistor Tr1 is turned on to write the video signal Vsig in the pixel capacitor Cs. The pixel capacitor Cs is sufficiently small as compared with the equivalent capacitor Coled of the light emitting element EL. As a result, most of the video signal Vsig is written in the pixel capacitor Cs. To be accurate, the difference of Vsig with respect to Vss1, namely, Vsig−Vss1 is written in the pixel capacitance Cs. Therefore, the voltage Vgs between the gate G and the source S of the drive transistor Trd becomes a level (Vsig−Vss1+Vth) in which Vth already detected and stored is added to Vsig−Vss1 sampled at this time. Hereinafter, for simplifying the explanation, when Vss1=0V, the voltage Vgs between gate/source becomes Vsig+Vth as shown in the timing chart of FIG. 4. The sampling of the video signal Vsig is performed until a timing T7 when the control signal WS returns to the low level. That is, the timing T5 to T7 corresponds to the sampling period.

In a timing T6 before the timing T7 when the sampling period ends, the control signal DS becomes the low level and the switching transistor Tr4 is turned on. Accordingly, since the drive transistor Trd is connected to the power supply VDD, the pixel circuit proceeds from the non-light emitting period to the light emitting period. In the period T6 to T7 when the sampling transistor Tr1 is still in the on-state as well as the switching transistor Tr4 comes to the on-state, the mobility correction of the drive transistor Trd is performed. That is, in the embodiment of the invention, the mobility correction is performed in the period T6 to T7 when the last part of the sampling period overlaps with the head part of the light emitting period. At the head part of the light emitting period when the mobility correction is performed, the light emitting element EL is in the reverse bias state in actual, therefore, light is not emitted. In the mobility correction period T6 to T7, the drain current Ids flows in the drive transistor Trd in a state in which the gate G of the drive transistor Trd is fixed to the level of the video signal Vsig. Since the light emitting element EL is on the reverse bias state by setting as Vss1−Vth<VthEl, the light emitting element EL shows a simple capacitance characteristic not a diode characteristic. Therefore, the current Ids flowing in the drive transistor Trd is written in a capacitor C=Cs+Coled in which the pixel capacitor Cs and the equivalent capacitor Coled of the light emitting element EL are coupled. Accordingly, the source potential S of the drive transistor Trd rises. In the timing chart of FIG. 4, the rising is shown by ΔV. The rising ΔV is subtracted from the voltage Vgs between gate/source stored in the pixel capacitor Cs in the event, therefore, negative feedback is to be applied. Accordingly, the mobility μ can be corrected by feeding back the output current Ids of the drive transistor Trd negatively to the input voltage Vgs of the drive transistor Trd. An amount of negative feedback ΔV can be optimized by adjusting a time width "t" of the mobility correction period T6 to t7.

In the timing T7, the control signal WS becomes the low level and the sampling transistor Tr1 is turned off. As a result, the gate G of the drive transistor Trd is disconnected from the signal line SL. Since the application of the video signal Vsig is cancelled, the gate potential G of the drive transistor Trd can rise, rising with the source potential S. Meanwhile, the voltage Vgs between gate/source stored in the pixel capacitor Cs maintains a value (Vsig−ΔV+Vth). As the source potential S rises, the reverse bias state of the light emitting element EL is cancelled, the light emitting element EL starts actually emitting light by the inflow of the output current Ids. The relation between the drain current Ids and the gate voltage Vgs is given as a formula 2 below by substituting Vsig−ΔV+Vth for Vgs of the formula 1 of the transistor characteristics.

$$Ids=k\mu(Vgs-Vth)2=k\mu(Vsig-\Delta V)2 \quad (2)$$

In the formula 2, k=(½)(W/L)Cox. From the characteristic formula 2, it is found that a term of Vth is cancelled and the output current Ids supplied to the light emitting element EL does not depend on the threshold voltage Vth of the drive transistor Trd. The drain current Ids is basically determined by the signal voltage Vsig of the video signal. In other words, the light emitting element EL emits light at the luminance in accordance with the video signal Vsig. At that time, Vsig is corrected by the amount of negative feedback ΔV. The correction amount ΔV just operates so as to negate the effect of the mobility μ placed at coefficient sections of the characteristic formula 2. Therefore, the drain current Ids substantially depends on only the video signal Vsig.

At last, when reaching a timing T8, the control signal DS becomes the high level and the switching transistor Tr4 is turned off, and the field ends when the light emitting ends. After that, the operation proceeds to the next field, and the Vth correction operation, the mobility correction operation and the light emitting operation are repeated again.

Figure 5:
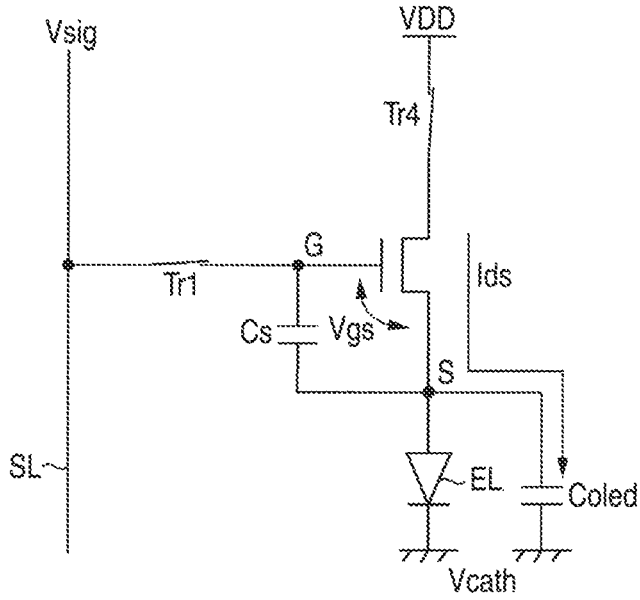
FIG. 5 is a circuit diagram for explaining operation of the same.

FIG. 5 is a circuit diagram showing a state of the pixel circuit 2 in the mobility correction period T6 to T7. As shown in the drawing, in the mobility correction period T6 to T7, the sampling transistor Tr1 and the switching transistor Tr4 are on, whereas the remaining switching transistors Tr2 and Tr3 are off. In this state, the source potential S of the drive transistor Tr4 is Vss1−Vth. The source potential S is also an anode potential of the light emitting element EL. As described above, by setting as Vss1−Vth<VthEL, the light emitting element EL is placed in the reverse bias state, showing the simple capacitance characteristic, not the diode characteristic. Therefore, the current Ids flowing in the drive transistor Trd flows into the resultant capacitor C=Cs+Coled resulting from the pixel capacitor Cs and the equivalent capacitor Coled of the light emitting element EL. In other words, part of the drain current Ids is fed back negatively to the pixel capacitor Cs to correct the mobility.

Figure 6:
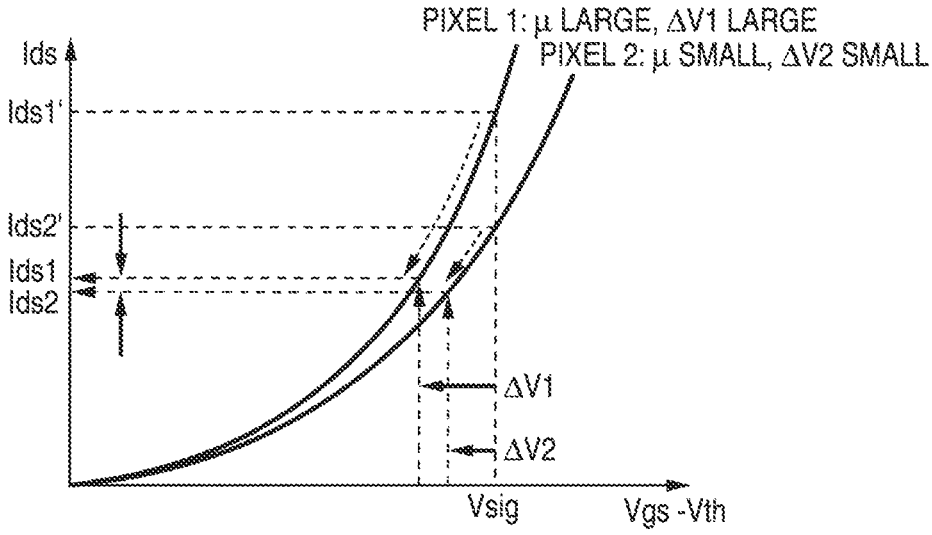
FIG. 6 is a graph for explaining operation of the same.

In FIG. 6, the above transistor characteristic formula 2 is graphed, taking Ids in the vertical axis and taking Vsig in the horizontal axis. The characteristic formula 2 is also shown below the graph. In the graph of FIG. 6, characteristic curves are drawn in a state in which a pixel 1 is compared with a pixel 2. A mobility μ of a drive transistor of the pixel 1 is relatively large. Reversely, the mobility μ of the drive transistor included in the pixel 2 is relatively small. In the case that the drive transistor is made of the polysilicon thin-film transistor or the like as described above, it is inevitable that the mobility μ varies according to the pixel. For example, when the signal potential Vsig of the video signal having the same level is written to both pixels 1, 2, output current Ids1' flowing in the pixel 1 having large mobility μ has large difference compared with output current Ids2' flowing in the pixel 2 having small mobility μ, when no mobility correction is performed. Since the large difference is generated between the output currents Ids caused by variations of the mobility μ, unevenness in stripes occur and uniformity of the screen is lost.

In the embodiment of the invention, variations of the mobility are cancelled by feeding back output current negatively to input voltage side. As apparent from the preceding transistor characteristic formula 1, when the mobility is large, the drain current Ids becomes large. Therefore, the larger the mobility is, the larger the amount of negative feedback ΔV becomes. As shown in the graph of FIG. 6, the amount of negative feedback ΔV1 of the pixel 1 having the large mobility μ is larger than the amount of negative feedback Δ2 of the pixel 2 having the small mobility. Therefore, the larger the mobility μ is, the larger the negative feedback is applied, which enables variations to be reduced. As shown in the drawing, the correction of ΔV1 is applied to the pixel 1 having the large mobility μ, output current drastically falls from Ids1' to Ids1. On the other hand, since the correction amount Δ2 of the pixel 2 having the small mobility μ is small, the fall from the output current Ids2' to Ids2 is not so drastic. As a result, Ids1 becomes almost equal to Ids2, and mobility variations are cancelled. The cancellation of mobility variations are performed at all ranges of Vsig from the black level to the white level, therefore, uniformity of the screen becomes extremely high. To summarize the above, when there are pixels 1, 2 having different mobility, the correction amount ΔV1 of the pixel 1 having large mobility becomes small with respect to the correction amount ΔV2 of the pixel 2 having small mobility. That is to say, the larger the mobility is, the larger ΔV is, and the reduced value of Ids becomes large. Accordingly, current values of pixels having different mobility are uniformed and mobility variations can be corrected.

Hereinafter, numerical analysis of the above mobility correction is performed for reference. The analysis is performed by taking the source potential of the drive transistor Trd as a variable V in the state in which the transistor Tr1 and the transistor Tr4 are on as shown in FIG. 5. When the source potential S of the drive transistor Trd is V, the drain current Ids flowing in the drive transistor Trd is shown as a formula 3 below.

$$I_{ds}=K\mu(V_{gs}-V_{th})^2=K\mu(V_{sig}-V-V_{th})^2 \quad (3)$$

According to relation between the drain current Ids and the capacitor C (=Cs+Coled), Ids=dQ/dt=CdV/dt is proved as shown in a formula 4 below.

$$\text{From } I_{ds}=\frac{dQ}{dt}=C\frac{dV}{dt},\ \int\frac{1}{C}dt=\int\frac{1}{I_{ds}}dV \Leftrightarrow \quad (4)$$

$$\int_0^t\frac{1}{C}dt=\int_{-vth}^{v}\frac{1}{k\mu(V_{sig}-V_{th}-V)^2}dv \Leftrightarrow$$

$$\frac{k\mu}{C}t=\left[\frac{1}{V_{sig}-V_{th}-V}\right]_{-vth}^{v}=\frac{1}{V_{sig}-V_{th}-V}-\frac{1}{V_{sig}} \Leftrightarrow$$

$$V_{sig}-V_{th}-V=\frac{1}{\frac{1}{V_{sig}}+\frac{k\mu}{C}t}=\frac{V_{sig}}{1+V_{sig}\frac{k\mu}{C}t}$$

The formula 3 is substituted for the formula 4 and the both side are integrated. Here, an initial condition of the source voltage V is "−Vth", and mobility variation correction time (T6-T7) is "t". When the differential equation is solved, pixel current with respect to the mobility correction time "t" will be given as a formula 5 below.

$$I_{ds}=k\mu\left(\frac{V_{sig}}{1+V_{sig}\frac{k\mu}{C}t}\right)^2 \quad (5)$$

Figure 7:
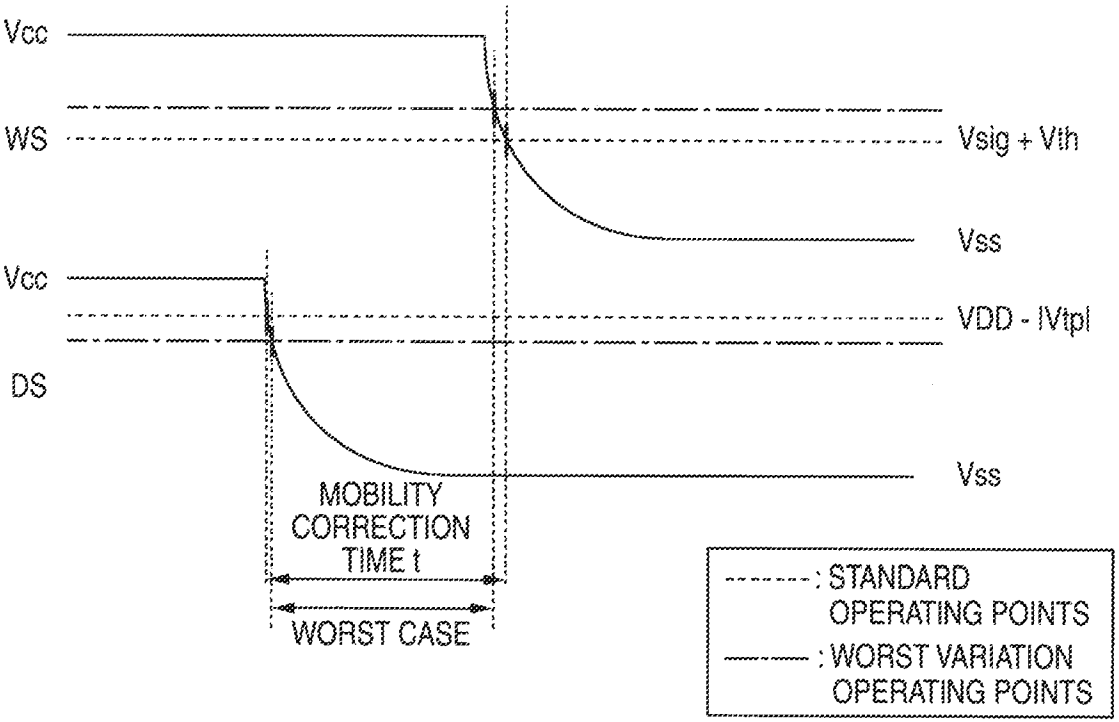
FIG. 7 is a waveform diagram for explaining operation of the same.

As described above, output current flowing in the light emitting element of each pixel is as shown in FIG. 5. In the formula 5, the mobility correction time "t" is set to several μs in the practical level. As described above, the mobility correction time is determined by an interval between on-timing (falling timing) of the switching transistor Tr4 and off-timing (falling timing) of the sampling transistor Tr1. FIG. 7 shows a falling waveform of the control signal DS to be applied to the gate of the switching transistor Tr4 and a falling waveform of the control signal WS to be applied to the gate of the sampling transistor Tr1 along the time axis. The scanning lines through which these control signals DS, WS are propagated are made of pulse wiring which is relatively high resistant such as metal molybdenum. Since overlapped parasitic capacitance between the pulse wiring and wiring of other layers is large, the time constant of the pulse wiring is large, the falling waveforms of the control signals DS, WS are slowed down. That is, respective control signals DS, WS does not rise from the power supply potential Vcc to the ground potential Vss for a moment, and the falling waveforms are slowed down by the effect of the time constant determined by wiring resistance or wiring capacitance. The falling waveforms are applied to gates of the switching transistor Tr4 or the sampling transistor Tr1.

The signal potential Vsig is supplied to the source of the sampling transistor Tr1. Therefore, the sampling transistor Tr1 is turned off when the gate potential is lower than Vsig+Vtn. Vtn is a threshold voltage of the N-channel sampling transistor Tr1. Generally, the threshold voltage Vtn of the sampling transistor Tr1 varies according to the pixel, affected by manufacturing processes. Therefore, when the falling waveform of the control signal WS is slowed down, differences occur in the off-timing of the sampling transistor Tr1, affected by variations of the threshold voltage Vtn. Therefore, differences appear at the end of the mobility correction time "t" according to the pixel.

Similarly, the source of the switching transistor Tr4 is connected to the power supply potential VDD of the pixel. Therefore, when the gate potential of the switching transistor Tr4 is lowered to VDD−|Vtp|, the switching transistor Tr4 is turned on. In this case, Vtp denotes a threshold voltage of the P-channel switching transistor Tr4. The threshold voltage Vtp also varies, affected by the manufacturing processes. Therefore, when the falling of the control signal Ds is slowed down, differences occur in the on-timing of the switching transistor Tr4, affected by variations of the threshold voltage Vtp. That is, differences occur in the beginning of the mobility correction period "t". In FIG. 7, standard operating points when the threshold voltage Vtn and Vtp are at the average level are shown by dotted lines and operating points in which variations of Vtn and Vtp are worst are shown by dashed lines. The mobility correction time is shorter in the worst case as compared with the standard mobility correction time "t". Reversely, there is a case in which the mobility correction time in the worst case becomes longer than the average mobility correction time "t".

Figure 8:
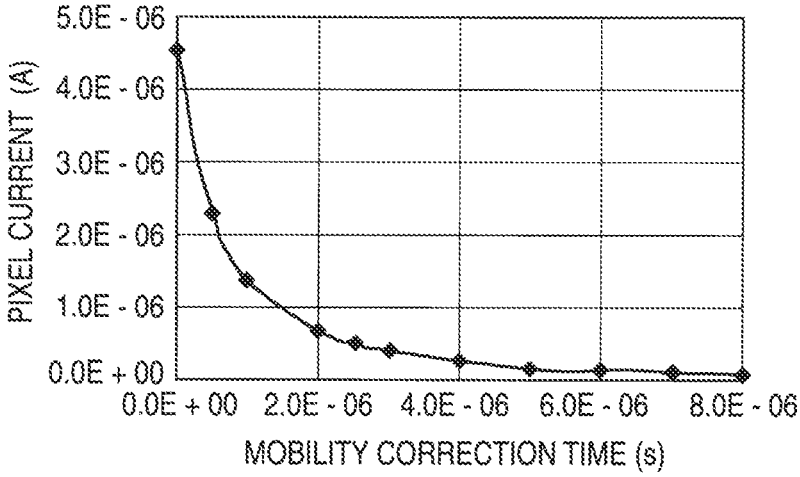
FIG. 8 is a graph for explaining operation of the same.

FIG. 8 is a graph showing relation between the mobility correction time and drive current (pixel current) flowing in the pixel. In the graph, the mobility correction time is taken at the horizontal axis and pixel current is taken at the vertical axis. As apparent from the graph, when the mobility correction time varies, the pixel current varies according to the pixel. Accordingly, the uniformity of the screen is lost. As described above, variations of the mobility correction time are chiefly caused by variations of the threshold voltage of the sampling transistor Tr1 or the switching transistor Tr4.

Figure 9:
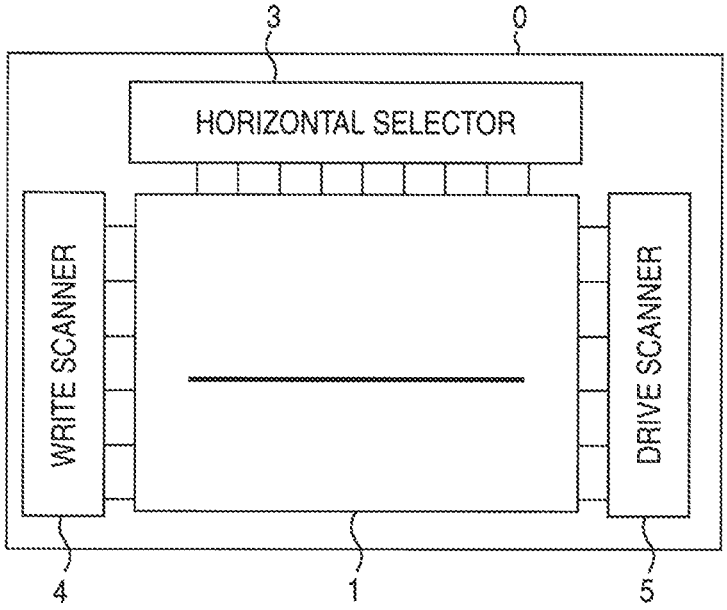
FIG. 9 is a schematic diagram for explaining operation of the same.

FIG. 9 is a schematic diagram for explaining the cause of threshold voltage variations of the thin-film transistors. As shown in the drawing, the display device is formed by a piece of insulating substrate, which is a flat panel 0. On the panel 0, in addition to the pixel array unit 1, the write scanner 4, the drive scanner 5, the horizontal selector 3 and the like are also integratedly formed in the periphery. These peripheral drive units are integratedly formed by thin-film transistors as same as the pixel array unit 1 at the center thereof. Generally, in the thin-film transistor, polycrystal silicon film is made to be an element region. The polycrystal silicon film is, for example, after an amorphous silicon thin-film is deposited on an insulating substrate, crystallized by irradiating laser and is converted to the polycrystal silicon thin-film. The irradiation of laser is performed by, for example, irradiating line laser beam to the panel 0 from top to bottom sequentially while being overlapped, thereby converting the amorphous silicon film to the polycrystal silicon film. When local variation of laser output occurs in the irradiation process of laser, differences occur in crystallinity of the polycrystal silicon film in the longitudinal direction of the panel 0, which appears as variations of the threshold voltage of the thin-film transistor in the event. Therefore, variations of the normal threshold voltage appear in the horizontal direction of the panel 0 along the lines of the laser beam. In the example of the drawing, correction time varies by the variation of the threshold voltage at a part of lines. As shown in FIG. 8, variations of the correction time lead to variations of pixel current, therefore, luminance unevenness appears in stripes along the lines. Since the amount of negative feedback with respect to the signal potential is reduced when the correction time is shorter than the average, stripes which are brighter than the periphery appear. Reversely, when the correction time is longer than the standard, the amount of negative feedback with respect to the signal potential increases, therefore, the signal potential is reduced and stripes which are darker the periphery appear.

Figure 10:
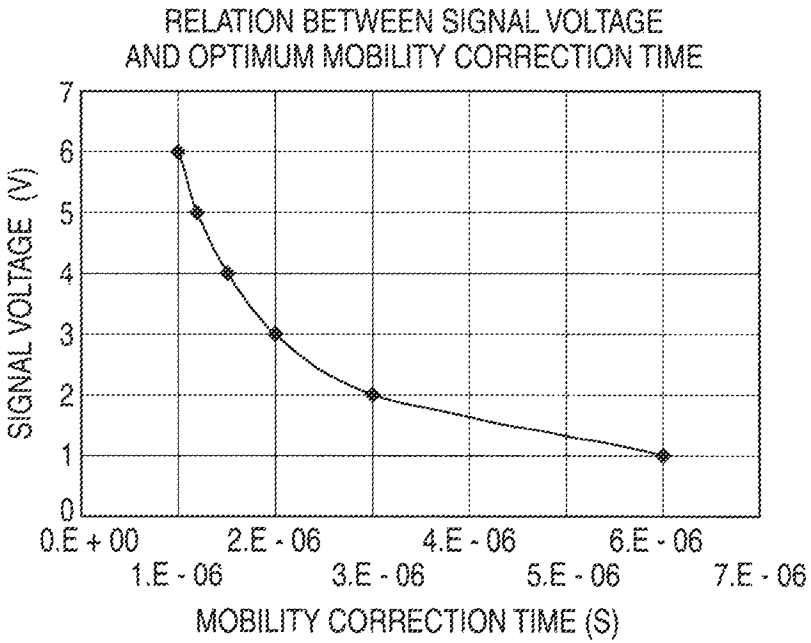
FIG. 10 is a graph showing relation between the signal potential and the optimum mobility correction time.

The optimum mobility correction time is not always fixed, and the optimum mobility correction time varies according to the signal voltage. FIG. 10 is a graph showing relation between the optimum mobility correction time and the signal voltage. As apparent from the drawing, when the signal voltage is high in the white level, the optimum mobility correction time is relatively short. When the signal voltage in the gray level, the optimum mobility correction time becomes longer, and when in the black level, the optimum mobility correction time tends to be further extended. As described above, during the mobility correction period, the correction amount ΔV to be fed back negatively in the pixel capacitor is in proportion to the signal voltage Vsig. When the signal voltage is high, the negative feedback amount becomes large accordingly, therefore, the optimum mobility correction time tends to be short. Reversely, when the signal voltage is reduced, the current supplying ability of the drive transistor is reduced, therefore, the optimum mobility correction time which is necessary for sufficient correction tends to be extended.

In the embodiment of the invention, the off-timing of the sampling transistor WS is automatically adjusted so that the correction time "t" becomes short when the signal potential Vsig of the video signal supplied to the signal line SL is high, on the other hand, so that the correction time "t" becomes long when the signal potential Vsig of the video signal supplied to the signal line SL is low. The principle thereof will be shown in FIG. 11.

Figure 11:
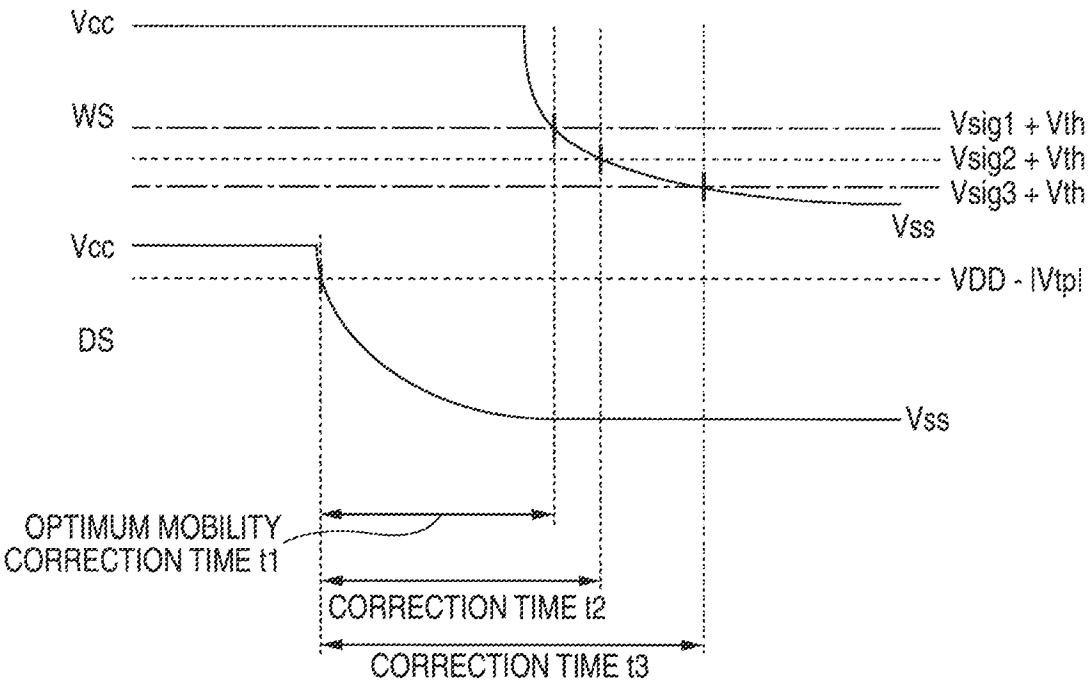
FIG. 11 is a waveform diagram for explaining operation of an embodiment of the invention.

A waveform diagram of FIG. 11 shows a falling waveform of the control signal DS and a falling waveform of the control signal WS which control the on-timing of the switching transistor Tr4 and the off-timing of the sampling transistor Tr1 which prescribe the mobility correction period "t". As described above, when the control signal DS applied to the gate of the switching transistor Tr4 becomes lower than VDD−|Vtp|, the switching transistor Tr4 is turned on, and the mobility correction time starts.

On the other hand, the control signal WS is applied to the gate of the sampling transistor Tr1. As shown in the drawing, the falling waveform thereof falls sharply from the power supply potential Vcc at the beginning, after that, falls gradually toward the ground potential Vss. When a signal potential Vsig1 applied to the source of the sampling transistor Tr1 is high in the white level, the gate potential of the sampling transistor Tr1 falls immediately to be Vsig1+Vtn, therefore, an optimum mobility correction time "t1" becomes short. When the signal potential is a Vsig2 in the gray level, the sampling transistor Tr1 is turned off when the gate potential falls from Vcc to Vsig2+Vtn. As a result, the optimum correction time "t2" which corresponds to Vsig2 in the gray level becomes longer than "t1". Furthermore, when the signal potential is a Vsig 3 which is close to the black level, the optimum mobility correction time "t3" becomes further longer than the optimum mobility correction time "t2" at the time of the gray level.

As described above, the write scanner 4 adjusts the off-timing of the sampling transistor Tr1 automatically so that the correction period "t1" becomes short when the signal potential Vsig1 of the video signal supplied to the signal line SL is high, and so that the correction period "t3" becomes long when the signal potential Vsig3 is low by allowing the falling waveform of the first control signal WS to be inclined when the sampling transistor Tr1 is turned off at the second timing. That is, the write scanner 4 optimizes the correction periods "t1", "t2" and "t3" at both cases when the signal potential Vsig1 is high and when the signal potentials Vsig2, 3 are low by allowing the falling waveform to be steep at first and then to be moderate, dividing the period into at least two stages when allowing the falling waveform of the first control signal WS to be inclined.

As described above, in the method in which the mobility correction time "t" is appropriately adjusted according to the signal potential Vsig, the falling of the control signal WS becomes an extremely slow shape corresponding to the optimum correction time when the signal potential is low. Such pulse waveform deteriorates the degree of variations of the mobility correction time "t" according to the variations of the threshold voltage Vtn of the sampling transistor Tr1. Particularly in the region where the signal potential Vsig is low, the optimum correction time "t3" varies a lot even when the threshold voltage Vtn of the sampling transistor Tr1 slightly varies. As a result, the unevenness in stripes tends to occur more noticeably.

Figure 12:
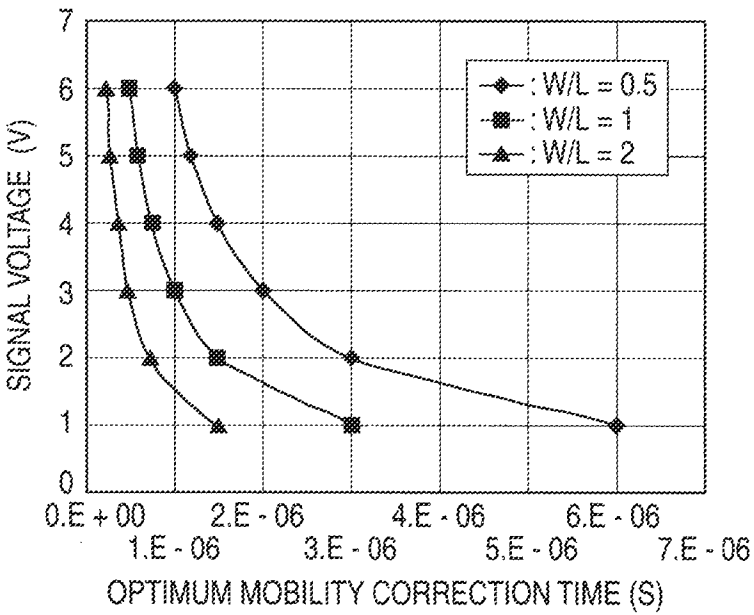
FIG. 12 is a graph for explaining operation of the embodiment of the invention.

In order to remove such problem, it is desirable to shorten the optimum mobility correction time over the whole signal potential from high to low. The degree of slowing down in the falling waveform of the control signal WS can be reduced by shortening the correction time, therefore, the mobility correction time is hardly affected by threshold voltage variations by the sampling transistor Tr1. In the embodiment of the invention, a size ratio (W/L) of the drive transistor Trd is set to large for shortening the optimum mobility correction period. FIG. 12 is a graph showing relation between the optimum mobility correction time and the signal voltage, and particularly takes the size ratio W/L of the drive transistor Trd as parameters. As apparent from the graph, the larger the size ratio of the drive transistor Trd takes, the higher the current supplying ability becomes, which enables the optimum mobility correction time to be shorten over the whole potential. The size ratio W/L of the drive transistor Trd in related arts was set to less than 0.5. That is, the channel width (gate width) W of the drive transistor Trd is designed so as not to reach half of the channel length (gate length) L. In the embodiment of the invention, this is improved, and the size ratio W/L of the drive transistor Trd is taken as 0.5 or more to shorten the optimum mobility correction time, thereby allowing the falling waveform of the control signal WS to be steep as compared with the related arts. The effects of variations of the threshold voltage of the sampling transistor Tr1 is hardly be received by allowing the falling waveform to be steep over the whole. As apparent from the graph of FIG. 12, the optimum mobility correction time can be effectively shortened over all levels of the signal voltage by allowing the size ratio W/L of the drive transistor Trd to be preferably 1 or more.

Figure 13:
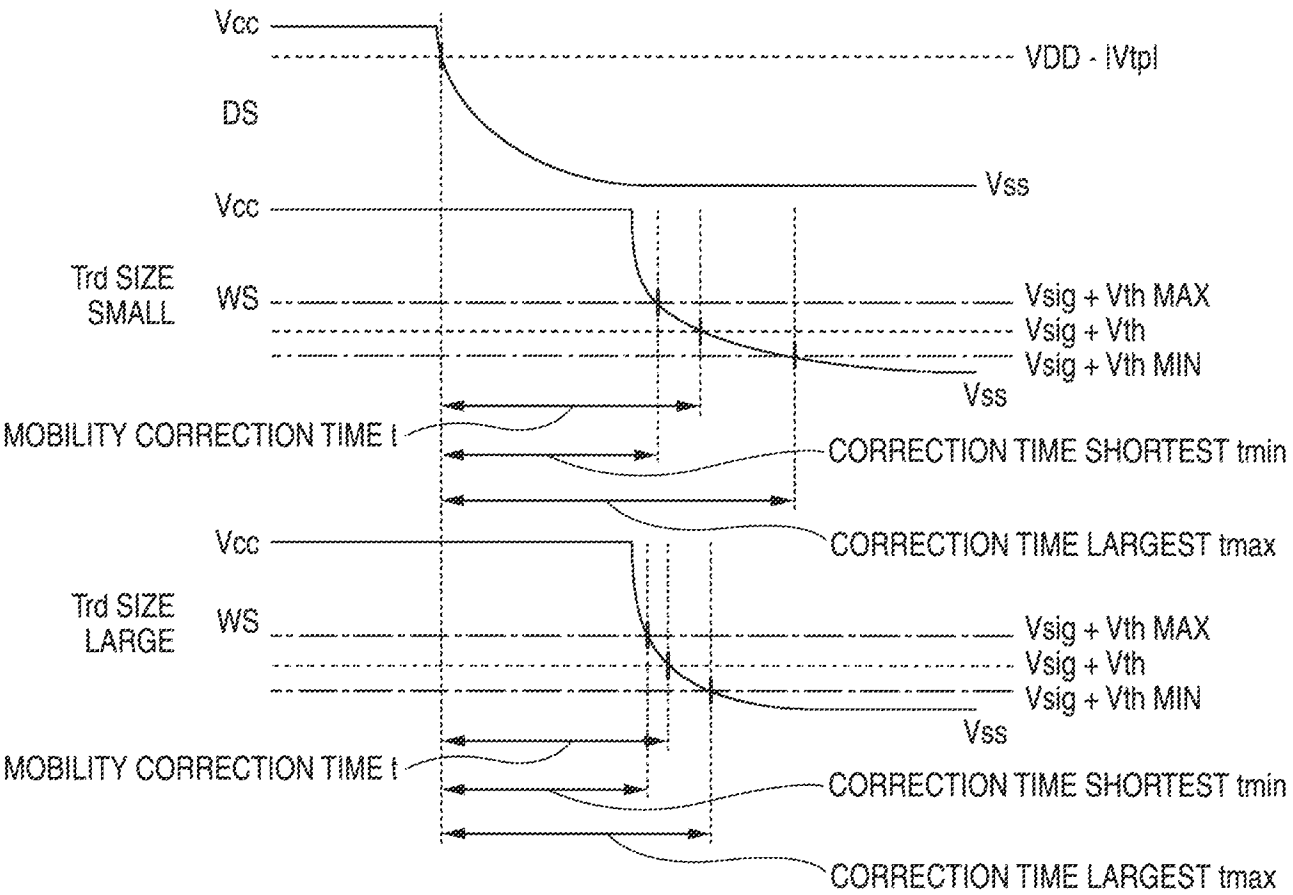
FIG. 13 is a waveform diagram for explaining operation of an embodiment of the invention.

FIG. 13 is a waveform diagram indicating effects of the embodiment of the invention, which shows falling waveforms of the control signals DS, WS. The upper half of FIG. 13 is a case in which the size of the drive transistor Trd is small, in which the falling waveform of the control signal WS is not particularly made to be steep. Whereas the waveform of the control signal WS in the lower side is a case in which the falling waveform of the control signal WS is made to be steep by allowing the size ratio of the drive transistor Trd to be large.

In the case that the falling of the control signal WS is not made to be steep, when the threshold voltage Vtn of the sampling transistor Tr1 varies between the minimum value VtnMIN and the maximum value VthMAX, the mobility correction time "t" varies between the shortest "tmin" and the longest "tmax". The signal potential Vsig is placed in a relatively low level, which is the level strongly affected by variations of the threshold voltage Vtn of the sampling transistor Tr1.

On the other hand, in the case that the falling waveform of the control signal WS is allowed to be steep, when the threshold voltage Vtn of the sampling transistor Tr1 varies between VtnMIN and VtnMAX, the mobility correction time "t" also varies from the shortest "tmin" to the longest "tmax", however, the variation width of the mobility correction time "t" becomes apparently narrow as compared with the case in which the falling waveform of the control signal WS is not made to steep at all.

As described above, the falling waveform of the control signal WS can be steep by setting the size of the drive transistor Trd to be large. Therefore, the variation amount of the mobility correction time "t" becomes small even when the threshold voltage of the sampling transistor Tr1 varies. As a result, the screen failure of unevenness in stripes can be reduced. The size ratio of the drive transistor may be larger than the size in related arts, however, it is preferable that W/L is 1 or more.

Figure 14:
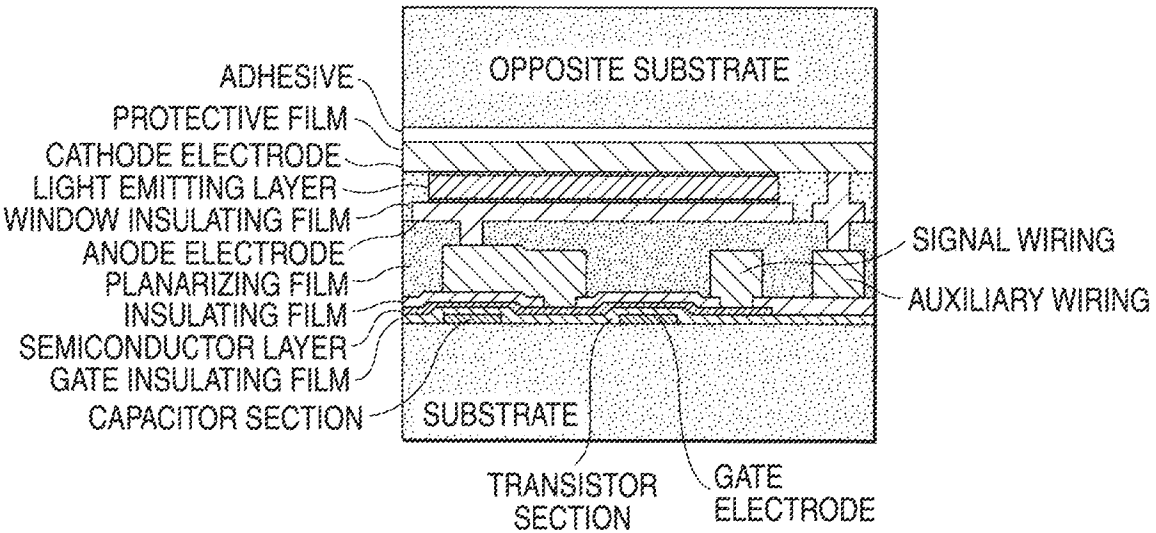
FIG. 14 is a cross-sectional view showing a device configuration of the display device according to an embodiment of the invention.

The display device according to an embodiment of the invention has a thin-film device structure as shown in FIG. 14. The drawing shows a schematic cross-sectional structure of a pixel formed on an insulating substrate. As shown in the drawing, the pixel includes a transistor section including plural thin-film transistors (in the drawing, one TFT is exemplified), a capacitor section such as a storage capacitor and a light emitting section such as an organic EL element. The transistor section and the capacitor section are formed on the substrate by a TFT process, and the light emitting section such as the organic EL element is stacked thereon. A transparent opposite substrate is adhered thereon through an adhesive to make a flat panel.

Figure 15:
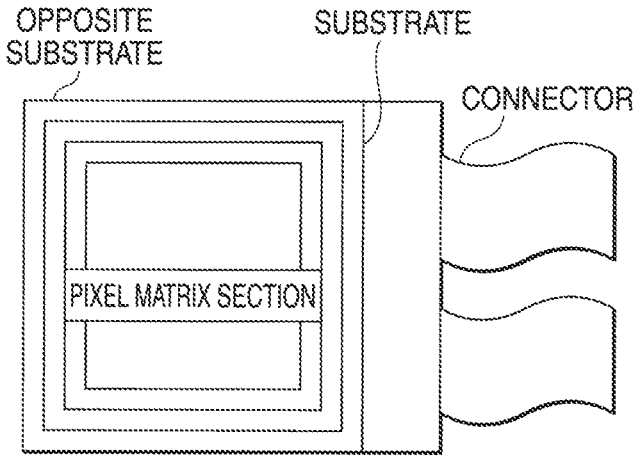
FIG. 15 is a plan view showing a module configuration of the display device according to an embodiment of the invention.

The display device according to an embodiment of the invention includes a flat-type device which has a module shape as shown in FIG. 15. For example, a pixel array unit in which a pixel having the organic EL element, thin-film transistors and a thin-film capacitor and the like are formed by integration in a matrix state is provided on an insulating substrate, an adhesive is arranged so as to surround the pixel array unit (a pixel matrix unit), and an opposite substrate such as a glass is adhered to make a display module. The transparent opposite substrate may have a color filter, a protective film or a shielding film and the like if necessary. The display module may have a FPC (flexible print circuit) as a connector for inputting and outputting signals and the like to the pixel array unit from outside.

The display device according to an embodiment of the invention described above has a flat-panel shape and can be applied to displays of various fields of electronic equipment such as a digital camera, a notebook personal computer, a cellular phone, and a video camera, which display video signals inputted in the electronic equipment or generated in the electronic equipment as images or pictures. Hereinafter, examples of the electronic equipment to which the display device is applied will be shown.

Figure 16:
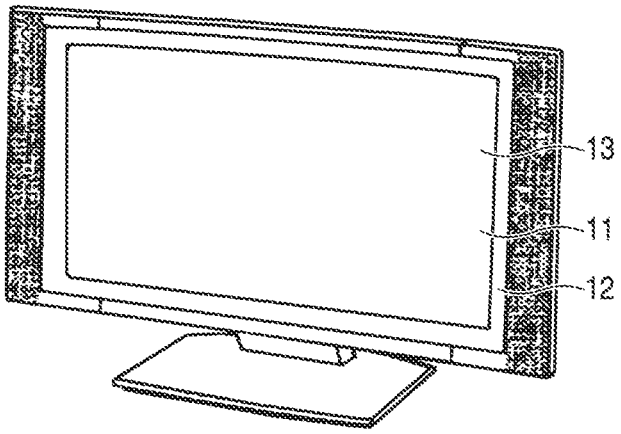
FIG. 16 is a perspective view showing a television set including the display device according to an embodiment of the invention.

FIG. 16 is a television to which an embodiment of the invention is applied, including a video display screen 11 having a front panel 12, a filter glass 13 and the like, which is fabricated by using the display device of the embodiment of the invention in the video display screen 11.

Figure 17:
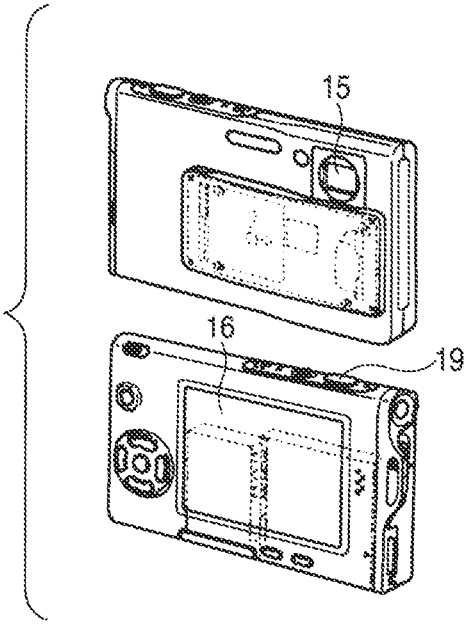
FIG. 17 is a perspective view showing a digital still camera including the display device according to an embodiment of the invention.

FIG. 17 is a digital camera to which an embodiment of the invention is applied, in which the upper drawing is a front view and the lower drawing is a rear view. The digital camera includes an imaging lens, light emitting section 15 for flash, a display section 16, a control switch, a menu switch, a shutter 19 and the like, which is fabricated by using the display device of the embodiment of the invention in the display section 16.

Figure 18:
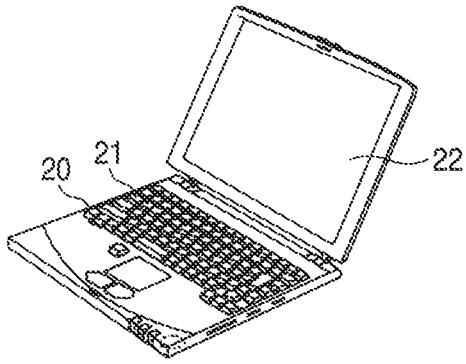
FIG. 18 is a perspective view showing a notebook personal computer including the display device according to an embodiment of the invention.

FIG. 18 is a notebook personal computer to which an embodiment of the invention is applied, including a keyboard 21 operated when inputting characters on a body 20 and a display section 22 on which pictures are displayed at a body cover, which is fabricated by using the display device of an embodiment of the invention in the display section 22.

Figure 19:
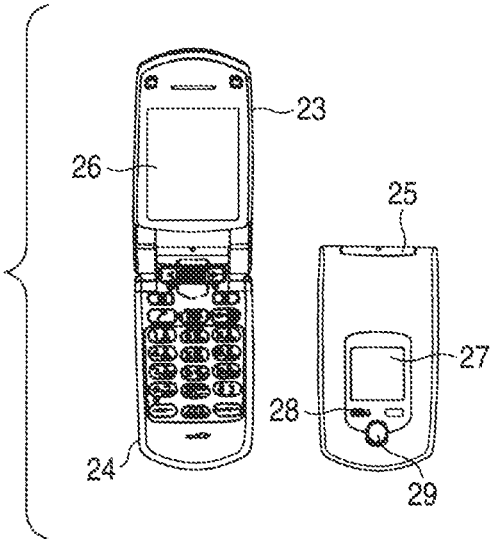
FIG. 19 is a schematic view showing a portable terminal device including the display device according to an embodiment of the invention.

FIG. 19 is a portable terminal device to which an embodiment of the invention is applied, in which the left shows an opened state and the right shows a shut state. The portable terminal device includes an upper casing 23, a lower casing 24, a connecting portion (in this case, a hinge portion) 25, a display 26, a sub-display 27, a picture light 28, a camera 29 and the like, which is fabricated by using the display device of the embodiment of the invention in the display 26 or in the sub-display 27.

Figure 20:
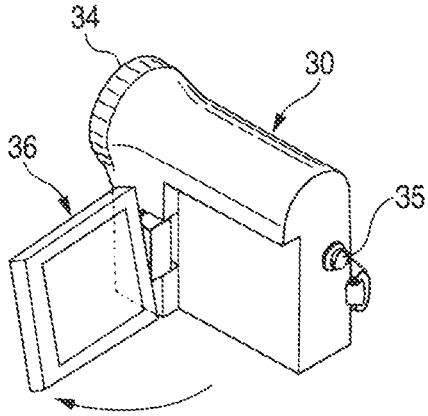
FIG. 20 is a perspective view showing a video camera including the display device according to an embodiment of the invention.

FIG. 20 is a video camera to which the embodiment of the invention is applied, including a body portion 30, a lens for taking subjects 34 at a side surface directed forward, a start/stop switch 35 at the time of taking, a monitor 36 and the like, which is fabricated by using the display device of the embodiment of the invention in the monitor 36.

It should be understood by those skilled in the art that various modifications, combinations, sub-combinations and alterations may occur depending on design requirements and other factors insofar as they are within the scope of the appended claims or the equivalents thereof.

What is claimed is:

1. A display device, comprising:

a plurality of pixels in a matrix, at least one of the plurality of pixels comprising:

a light emitting element;

a sampling unit;

a pixel capacitor; and a drive unit configured to allow a drive current to flow to the light emitting element according to an image signal stored in the pixel capacitor, wherein a feedback current is configured to flow to the pixel capacitor via the drive unit while the sampling unit supplies a potential corresponding to the image signal from a signal line, and before the drive unit allows the drive current to flow, and wherein the drive unit has a transistor whose size ratio W/L is at least 0.5, where W is a channel width and L is a channel length.

2. The display device according to claim 1, wherein the feedback current is configured to flow to the pixel capacitor via the transistor before the drive unit allows the drive current to flow.

3. The display device according to claim 2, wherein the pixel capacitor pixel capacitor is configured to store a voltage dependent on a property data of the transistor before the drive unit allows the drive current to flow.

4. The display device according to claim 1, wherein the sampling unit includes a sampling transistor having a gate electrode, the gate electrode being connected to a scan line.

5. The display device according to claim 4, wherein the sampling unit is configured to supply the potential corresponding to the image signal from the signal line in response to a scan pulse applied to the gate electrode of the sampling transistor from the scan line.

6. The display device according to claim 1, wherein the drive unit is configured to control the drive current to flow to the light emitting element in response to a potential applied to a gate electrode of the transistor.

7. The display device according to claim 6, wherein an input node of the drive unit is connected to the pixel capacitor.

8. The display device according to claim 7, wherein the input node corresponds to the gate electrode of the transistor.

9. A display device, comprising:

a plurality of pixels in a matrix, at least one of the plurality of pixels comprising:

a light emitting element;

a sampling unit;

a pixel capacitor; and a drive unit configured to allow a drive current to flow to the light emitting element according to a signal potential stored in the pixel capacitor in a light emission period, wherein a feedback current is configured to flow to the pixel capacitor via the drive unit while the sampling unit supplies a potential corresponding to the image signal from a signal line during a correction period before the light emission period, and wherein the drive unit is configured to shorten the correction period by increasing a supplying capability of drive current of the drive unit during the correction period.

10. The display device according to claim 9, wherein the supplying capability of drive current is dependent on size ratio W/L, where W is a channel width and L is a channel length.

11. The display device according to claim 9, wherein the feedback current is configured to flow to the pixel capacitor via the transistor before the drive unit allows the drive current to flow.

12. The display device according to claim 11, wherein the pixel capacitor pixel capacitor is configured to store a voltage dependent on a property data of the transistor before the drive unit allows the drive current to flow.

13. The display device according to claim 9, wherein the sampling unit includes a sampling transistor having a gate electrode, the gate electrode being connected to a scan line.

14. The display device according to claim 13, wherein the sampling unit is configured to supply the potential corresponding to the image signal from the signal line in response to a scan pulse applied to the gate electrode of the sampling transistor from the scan line.

15. The display device according to claim 9, wherein the drive unit is configured to control the drive current to flow to the light emitting element in response to a potential applied to a gate electrode of the transistor.

16. The display device according to claim 15, wherein an input node of the drive unit is connected to the pixel capacitor.

17. The display device according to claim 16, wherein the input node corresponds to the gate electrode of the transistor.

18. A display device, comprising:

a first voltage line, a second voltage line, a third voltage line, and a plurality of pixels in a matrix state, at least one of the plurality of pixels comprising:

a light emitting element;

a switching unit connected between the third voltage line and the light emitting element;

a pixel capacitor; and a drive unit connected to the light emitting element between the first power line and the second power line, wherein the drive unit is configured to allow a drive current to flow in the light emitting element according to a signal stored in the pixel capacitor, wherein the drive current is able to be fed back negatively to the pixel capacitor, and wherein the drive unit has a transistor whose size ratio W/L is at least 0.5, where W is a channel width and L is a channel length.

19. An electronic equipment including a display device, comprising:

a plurality of pixels in a matrix, at least one of the plurality of pixels comprising:

a light emitting element;

a sampling unit;

a pixel capacitor; and a drive unit configured to allow a drive current to flow to the light emitting element according to an image signal stored in the pixel capacitor, wherein a feedback current is configured to flow to the pixel capacitor via the drive unit while the sampling unit supplies a potential corresponding to the image signal from a signal line, and before the drive unit allows the drive current to flow, and wherein the drive unit has a transistor whose size ratio W/L is at least 0.5, where W is a channel width and L is a channel length.

20. The electronic equipment according to claim 19, wherein the feedback current is configured to flow to the pixel capacitor via the transistor before the drive unit allows the drive current to flow.

21. The electronic equipment according to claim 20, wherein the pixel capacitor pixel capacitor is configured to store a voltage dependent on a property data of the transistor before the drive unit allows the drive current to flow.

22. The display device according to claim 19, wherein the sampling unit includes a sampling transistor having a gate electrode, the gate electrode being connected to a scan line.

23. The display device according to claim 22, wherein the sampling unit is configured to supply the potential corresponding to the image signal from the signal line in response to a scan pulse applied to the gate electrode of the sampling transistor from the scan line.

24. The display device according to claim 19, wherein the drive unit is configured to control the drive current to flow to the light emitting element in response to a potential applied to a gate electrode of the transistor.

25. The display device according to claim 24, wherein an input node of the drive unit is connected to the pixel capacitor.

* * * * *